United States Patent [19]

Dodge

[11] 4,181,394

[45] Jan. 1, 1980

[54] CORD ATTACHMENT PLUG

[75] Inventor: Donald M. Dodge, Long Beach, Calif.

[73] Assignee: Pacific Electricord Company, Gardena, Calif.

[21] Appl. No.: 697,143

[22] Filed: Jun. 17, 1976

[51] Int. Cl.[2] ..... H01R 13/58

[52] U.S. Cl. ..... 339/103 R; 339/106; 339/218 R

[58] Field of Search ..... 339/103, 106, 218

[56] References Cited

U.S. PATENT DOCUMENTS

| | | | |
|---|---|---|---|
| 2,132,870 | 10/1938 | Geyer | 339/106 |
| 2,857,579 | 10/1958 | Scanlon | 339/218 R |
| 3,296,387 | 1/1967 | Le Baigue | 339/103 R |

FOREIGN PATENT DOCUMENTS

| | | | |
|---|---|---|---|
| 124581 | 9/1944 | Australia | 339/218 C |
| 1020395 | 12/1957 | Fed. Rep. of Germany | 339/106 |

*Primary Examiner*—Neil Abrams

*Attorney, Agent, or Firm*—Fulwider, Patton, Rieber, Lee & Utecht

[57] ABSTRACT

There is disclosed an electrical cord and attachment plug assembly suitable for use in applications requiring a very high degree of reliability, e.g., for use on hospital and life support equipment and the like. The assembly is of a construction which insures that the electrical cord, or any of the single conductors thereof, does not pull out of the plug assembly and interrupt the electrical continuity. The assembly includes an electrical cord having a plurality of single conductors within an outer jacket and bearing a plurality of contact members, including a pair of flat-bladed prongs connected distally to respective ones of a pair of the single conductors with each of the single conductors knotted adjacent the contact members. The cord also bears cord-retaining bushings clamped about the jacket of the cord. The end of the electrical cord is received within a molded attachment plug body and the cord-retaining bushings and the knotted ends of the single conductors with their attached contact members are entirely embedded within the molded plug.

10 Claims, 5 Drawing Figures

FIG. 1
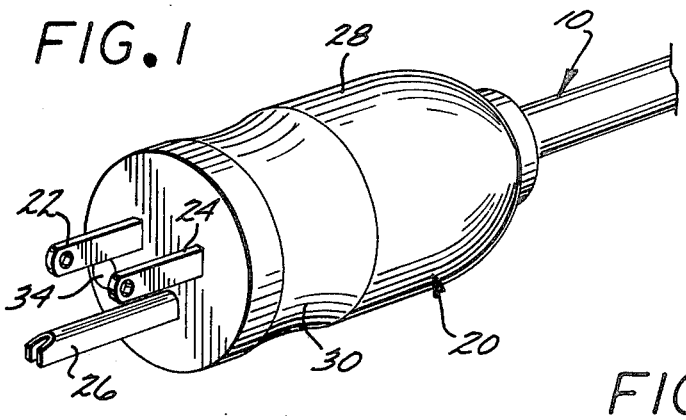
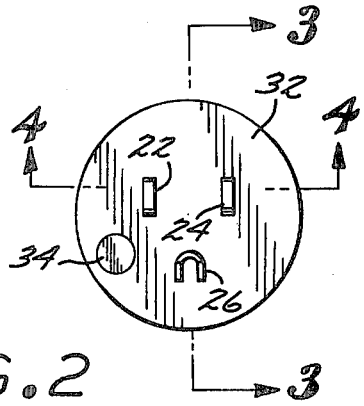
FIG. 2
FIG. 3
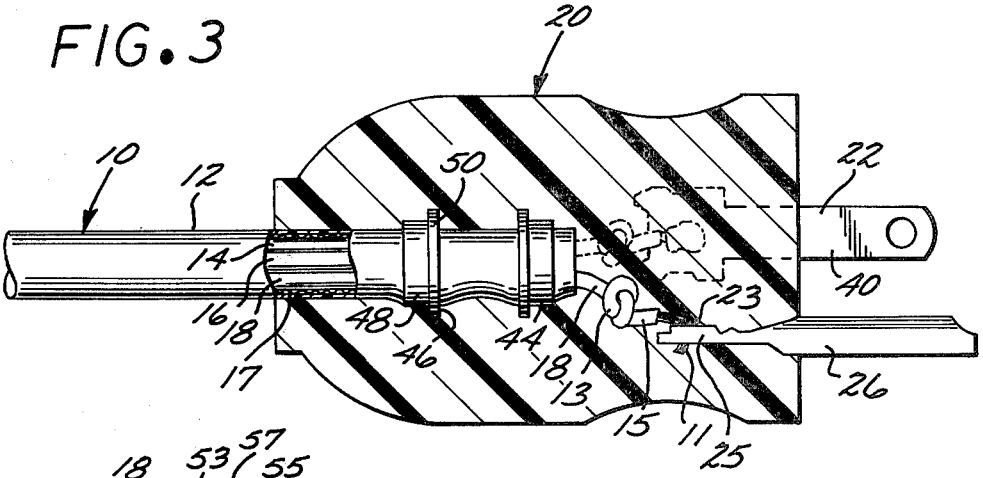
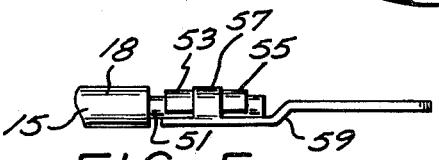
FIG. 5
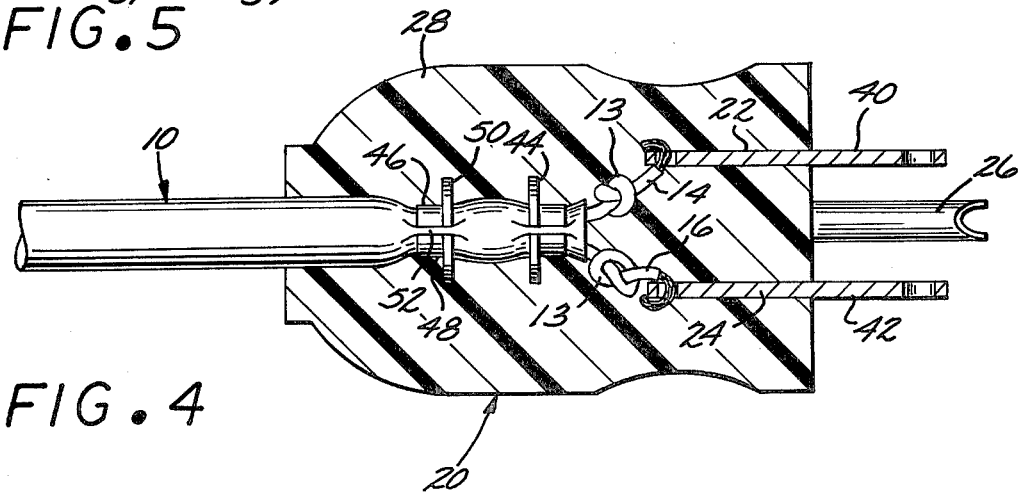
FIG. 4

CORD ATTACHMENT PLUG

BACKGROUND OF THE INVENTION

1. Field of the Invention

This invention relates to an electrical cord and attachment plug assembly and, in particular, to an assembly having a molded attachment plug.

2. Description of the Prior Art

Attachment plugs carried on the end of electrical cords are generally of an assembled or molded construction. With assembled construction, it is conventional to loop the single conductors about posts and the like within the body of the plug which is mechanically assembled about the contact members. With molded plug construction, the single conductors are secured to the contact members and this subassembly is placed within a die cavity that is closed and a thermoplastic or thermosetting resin is injected into the die to embed the assembled electrical cord and contact members.

In some applications, particularly for use on hospital and life support equipment, it is essential that the assembly of the electrical cord and attachment plug resist failure. Recent specifications for this service have required that the assembly be of equal or greater strength that the strength of the electrical cord. This strength cannot be achieved by the conventional molded plug assembly since the single conductors will, with application of sufficient stress, separate from the contact members resulting in failure of the electrical continuity of the assembly.

BRIEF STATEMENT OF THE INVENTION

This invention comprises an electrical cord and attachment plug assembly having a high degree of strength that is equal to or greater than the strength of the electrical cord, such that the application of sufficient stress to the assembly to cause failure, will result in failure of the electrical cord and will not result in breaking of the contact between the attachment plug contact element and the single conductors of the electrical cord.

The invention comprises an electrical cable with a plurality of single conductors, typically three, bearing conductor insulation and extending distally from a surrounding cord jacket. The plurality of contact members, including a pair of flat-bladed prongs, are carried distally by respective ones of a pair of the single conductors and are secured thereto by interlocking means, typically by soldering and/or crimping of the conductors to the connecting terminal of the contact members. Each of the single conductors also bears knot means such as an overhand knot adjacent its connection to the contact element and the cord distally bears retaining bushings which are clamped about the jacket of the cord. The entire assembly of contact members and electrical cord is received within and entirely embedded by the molded body of an attachment plug.

The molded body of the attachment plug supports the contact members in their spaced-apart orientation, including the conventional parallel alignment of the flat-bladed contact members. The molded plug body also receives and embeds the knots of each of the single conductors and the cord-retaining bushings.

It has been found that the use of the retaining bushings without the use of the knots in the end of the single conductors, or the use of the knotted single conductors, without the retaining bushings, results in an assembly in which the single conductors can be strained sufficiently to separate from the respective contact member, breaking electrical continuity or the jacket of the cord may be torn free of the rear of the attachment plug.

In contrast, the assembly having both the retaining bushings and knotted single conductors achieves a construction in which the assembly has greater strength than that of the electrical cord and the application of continuing stress to the cord and plug assembly results in failure of the electrical cord rather than failure of the assembly.

BRIEF DESCRIPTION OF THE DRAWINGS

The invention will be described with reference to the figures of which:

FIG. 1 is a perspective view of an assembly of the invention;

FIG. 2 is an end view of the attachment plug;

FIG. 3 is a cross sectional elevational view along lines 3—3 of FIG. 2;

FIG. 4 is a sectional view along the lines 4—4 of FIG. 2; and

FIG. 5 is a view of an alternative, crimped connecting element.

DESCRIPTION OF THE PREFERRED EMBODIMENTS

Referring now to FIG. 1, the invention is shown as the assembly of an electrical cord 10 and a molded attachment plug 20 distally carried thereon. The attachment plug 20 bears the conventional contact elements including a pair of flat-bladed prongs 22 and 24 and can have a conventional, channel-shaped or round prong 26 commonly used for grounding. The body 28 of the attachment plug is a generally elongated cylindrical body which can be provided with a gripping surface 30 as an annular groove thereabout.

The terminal end of attachment plug 20 has a flat face 32 which can bear a conventional indicia 34 and/or other markings to indicate approval of the the construction for particular applications, e.g., for hospital and life support equipment used.

Referring now to FIG. 3, the electrical cord 10 has a conventional outer jacket 12 with a plurality of single conductors 14, 16, and 18. The single conductors are interspaced within the jacket 12 by separator 17 of insulating material such as paper, jute, nylon, etc. The single conductors bear separate insulation as shown by insulation 15 which extends about conductor 18. The single conductors extend distally from the jacket 12 and bear knot means such as an overhand knot 13. The ends of the conductors are stripped of insulation and extend into contact and attachment to the connecting elements such as 22 and 24 which bear the spaced-apart, flat-bladed prongs 40 and 42 or the grounding prong 26. The exposed ends of the single conductors such as end 11 are engaged with the connector terminal of the contact members. The connector terminal such as the terminal 25 of connector 26 bears attachment means for securing of the end of the single conductor. In the illustrated embodiment, the connector terminal is a flat pad bearing an aperture through which end 11 of the conductor is inserted. Preferably, the connection is secured by a solder joint 23 and the like.

The cord also bears strain relief bushing means of one or more bushings such as bushings 44 and 46. Preferably two bushings of conventional shape are used to obtain the desired strain relief. Each bushing comprises a sleeve portion 48 which extends about the cord and an annular, dependent flange 50 thereon. As shown in FIG. 4, the bushings have an axial slot 52 which permits the bushings to be crimped tightly about the cord in the manner shown in FIG. 4. FIG. 4 also illustrates that each of the pair of conductors 14 and 16 also bear knot means 13 in the form of a simple, overhand knot which is spaced intermediate of the bushings 46 and 44 and the contact elements 22 and 24.

The length of the molded body 28 of the attachment plug 20 is sufficient that the cord-retaining bushings 44 and 46, as well as the knots 13, are embedded in central portion of the plug body, thereby insuring maximum retention strength of the retaining means within the molded body.

It has been found that the aforementioned construction provides an assembly which is of a strength that exceeds the tensile strength of the cord 20 such that the application of excessive stress to the cord results in rupture of the cord 20 rather than separation of any of the single conductors from their respective contact element. This high strength of the assembly is achieved by the combined use of the retaining means, including the cord-retaining means such as bushings 44 and 46, in combination with the knot means 13 in each of the single conductors. Because the knot means are embedded within the plastic of the molded body 28, a simple overhand knot provides sufficient retention within the plug to provide the desired tensile strength of the assembly. Alternatively, other knots could be employed if desired. The interconnection between the single conductors and their respective contact members is preferably secured by soldering and the like. Instead of, or besides, this connection, the single conductors could be secured with a crimped metal clamp, e.g., the terminal or connector end of the contact members could be provided with a leaf construction which could be compressed about the ends of the conductors by crimping, pinching and the like. FIG. 5 shows this alternative construction wherein the end of conductor 18 is stripped of the outer insulation 15 to expose the wire 51 which is placed between tabs 53 and 55 and a center prong 57, all carried by the blade element 59. The tabs and prong are then crimped about the received end of wire 51 to secure the assembly.

The invention has been described with reference to the presently preferred and illustrated embodiment thereof. It is not intended that the invention be unduly limited by the illustrated embodiment. Instead, the invention is intended to be defined by the means, and their obvious equivalents, set forth in the following claims.

What is claimed is:

1. An electrical cord and attachment plug assembly comprising:

an electrical cable having an outer jacket and a plurality of single conductors bearing electrical insulation and extending distally from said jacket;

a plurality of contact members including a pair of flat-bladed prongs carried distally by respective ones of a pair of said single conductors and secured thereto by interlock means;

knot means in each of said pair of single connectors adjacent its distal end;

cord retaining means clamped about the jacketed end of said cord and including at least a pair of spaced-apart slotted bushings, each bearing an annular flange; and a molded attachment plug body receiving said cord, cord retaining means, single conductors, knot means and contact members and molded thereabout to embed said retaining and knot means in said body and to support said prongs in a spaced-apart, parallel alignment.

2. The cord and plug assembly of claim 1 including a third, single conductor in said cord distally bearing knot means and a third contact member.

3. The cord and plug assembly of claim 2 wherein said third contact member is a channel-shaped prong.

4. The cord and plug assembly of claim 2 wherein said third contact member is a round prong.

5. The cord and plug assembly of claim 1 wherein said knot means comprises an overhand knot.

6. The cord and plug assembly of claim 1 wherein interlock means includes a solder joint between each of said conductors and contact members.

7. The cord and plug assembly of claim 1 wherein interlock means includes a solder joint between each of said conductors and contact members.

8. The cord and plug assembly of claim 7 wherein said knot means comprises an overhand knot.

9. The cord and plug assembly of claim 6 wherein said interlock means also includes mechanical clamp means between each of said conductors and contact members.

10. The cord and plug assembly of claim 8 wherein said interlock means also includes mechanical clamp means between each of said conductors and contact members.

* * * * *